US006089033A

United States Patent [19]

Dubé

[11] Patent Number: 6,089,033

[45] Date of Patent: Jul. 18, 2000

[54] HIGH-SPEED EVAPORATOR DEFROST SYSTEM

[76] Inventor: Serge Dubé, 2595 Bourgogne, St-Lazare, Quebec, Canada, J0P 1V0

[21] Appl. No.: 09/257,915

[22] Filed: Feb. 26, 1999

[51] Int. Cl.[7] ..... F25D 21/06

[52] U.S. Cl. ..... 62/156; 62/174; 62/278

[58] Field of Search ..... 62/155, 151, 152, 62/156, 126, 129, 174, 81, 277, 278, 509, 196.3

[56] References Cited

U.S. PATENT DOCUMENTS

| | | | |
|---|---|---|---|
| 2,978,877 | 4/1961 | Long | 62/278 X |
| 3,353,367 | 11/1967 | Garland et al. | 62/174 X |
| 3,988,904 | 11/1976 | Ross | 62/174 |
| 4,059,968 | 11/1977 | Ross | 62/174 |
| 4,979,371 | 12/1990 | Larson | 62/278 X |

*Primary Examiner*—Harry B. Tanner
*Attorney, Agent, or Firm*—Swabey Ogilvy Renault; Guy J. Houle

[57] ABSTRACT

A high-speed evaporator defrost system is comprised of a defrost conduit circuit connected to the discharge line of one or more compressors and back to the suction header through an auxiliary reservoir capable of storing the entire refrigerant load of the refrigeration system. Auxiliary reservoir is at low pressure and is automatically flushed into the main reservoir when liquid refrigerant accumulates to a predetermined level. The auxiliary reservoir of the defrost circuit creates a pressure differential across the refrigeration coil of the evaporators sufficient to accelerate the hot high pressure refrigerant gas in the discharge line through the refrigeration coil of the evaporator to quickly defrost the refrigeration coil even at low compressor head pressures and wherein the pressure differential across the coil is in the range of from about 30 p.s.i. to 200 p.s.i.

15 Claims, 2 Drawing Sheets

HIGH-SPEED EVAPORATOR DEFROST SYSTEM

TECHNICAL FIELD

Figure 1A:
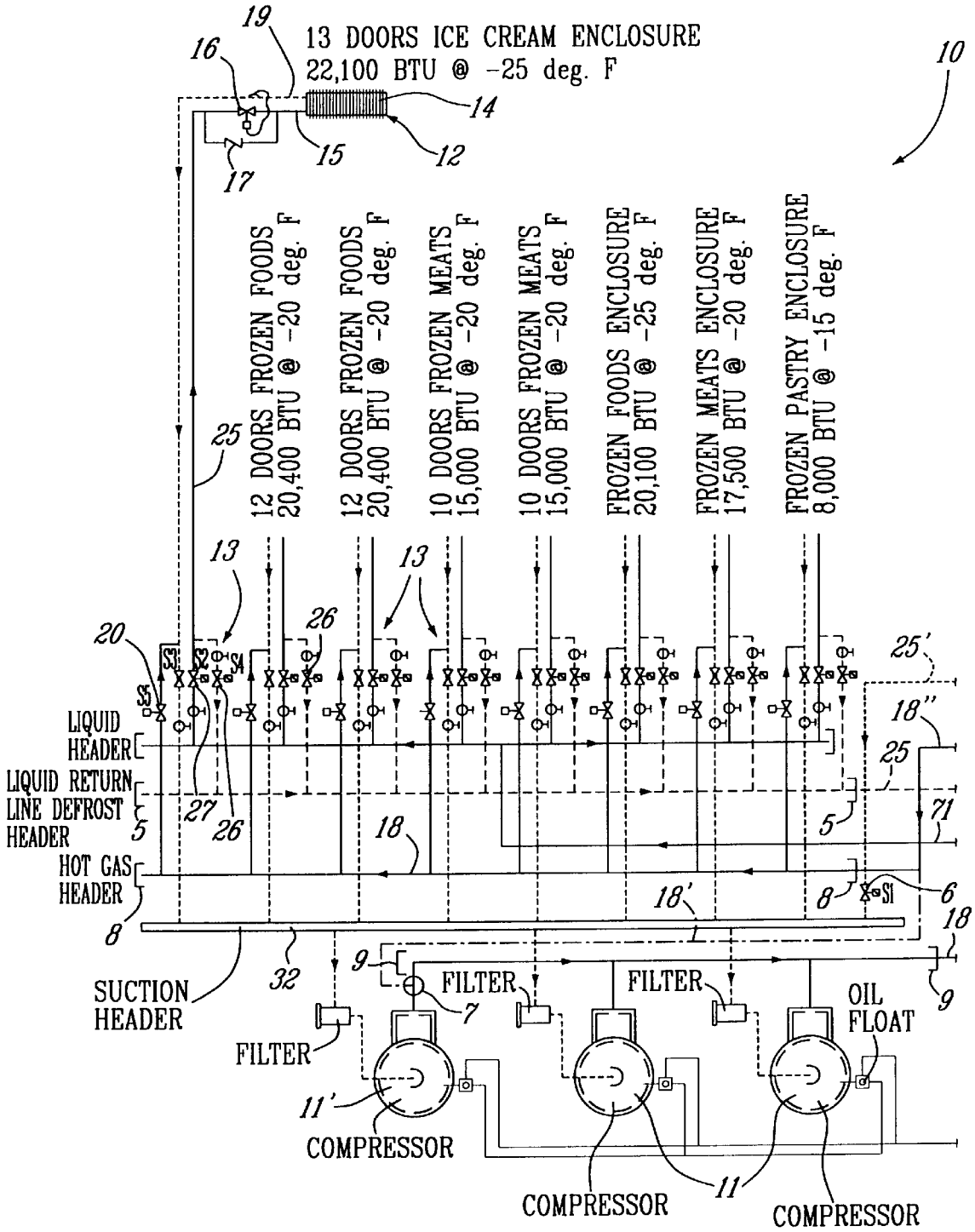

The present invention relates to a high-speed evaporator defrost system capable of defrosting refrigeration coils of evaporators in a very short period of time without adverse effects produce on food stuff being refrigerated in a fresh or frozen state and without having to increase compressor head pressure.

BACKGROUND OF THE INVENTION

In refrigeration systems which are used in the food industry to refrigerate fresh food or frozen foods, it is essential from time to time during the period of a day to defrost the refrigeration coils of the evaporators which become clogged up by the build-up of ice thereon during the freezing cycle and which obstruct the passage of air whereby to supply the display cases or refrigerated enclosures to maintain foodstuff refrigerated. For example, in refrigerated display cases, operating at medium temperature range, for meat, dairy, fruits, etc., the refrigeration coils of the evaporators may undergo three defrost cycles of 12 minutes during a 24 hour period. On the other hand, in refrigerated enclosures which are provided with doors to store frozen foods, the defrost cycle may be longer and usually will last for about 20 minutes.

There are essentially three ways to defrost refrigeration coils. One utilizes an air defrost method wherein fans are utilized to direct a warm air stream against the refrigeration coils while the refrigerant is cut out from circulating through the coils. This results in fairly lengthy defrost cycles and which can last up to about 40 minutes. Another method is to pass cooled gas through the refrigeration coils with the gas being taken from the top of the refrigerant reservoir at a temperature of from about 80° F. to 90° F. Because the gas is circulated slowly within the refrigerant coils due to the pressure in the system, the defrost cycle is fairly lengthy. Another system utilizes hot gas defrost as briefly described in my U.S. Pat. No. 5,673,567 entitled "Refrigeration System with Heat Reclaim and Method of Operation". In that system hot gas from the compressor discharge line is fed to the refrigerant coil via a valving circuit and back into the liquid manifold to mix with the refrigerant liquid. This method of defrost usually takes about 12 minutes for defrosting evaporators associated with meat display cases and about 22 minutes for defrosting frozen food enclosures.

Because of the lengthy defrost cycles of existing defrost systems, the refrigeration system as well as the foodstuff is subject to adverse effects. For example, during the defrost cycle, compressor head pressure is increased and the energy cost increases. Also, the compressors are subjected to overheating after the defrost cycle when the hot gas comes back through the suction header and the life thereof is therefore reduced. Known defrost systems also operate at high pressure, such as the system described in my above-mentioned U.S. Patent, and this is due to the fact that the refrigerant liquid in the liquid line is at substantially the same pressure as the gas in the hot gas manifold of the compressors. The compressors therefore need to work harder to pump the hot gas through the evaporators at higher pressure to have a pressure differential of about 30 p.s.i. across the evaporator.

The foodstuff which is to be refrigerated and which is placed in display cases, such as fresh packaged meat placed in trays and wrapped with plastic film, fresh vegetables and seafoods, milk, drinks, cold-cuts, or like prepared meats, etc., it is desirable to maintain these at a medium refrigerated temperature. However, some of these products have been found to deteriorate during the defrost cycle. As an example only, when poultry is displayed in such cases and packaged in a plastic wrap, it has been found that the flesh of the poultry may change color when subjected to an important temperature variation. With fish, the freshness of the fish deteriorates, although this is not visually apparent. Cheeses can also deteriorate more rapidly during the defrost cycle and milk will not retain its freshness as long. In the trade, sometimes the butchers will rewrap the meat product which discolor and this is known not to be sanitary. Furthermore, after one and a half days of exposure in display counters, meat in such refrigerators has to be reprocessed into ground meat or discarded. Accordingly, it can be appreciated that expensive meat such as tenderloins, etc. when reprocessed into ground meat will demand a much lower price. Because of Governmental health regulations and laws, it is required that many of these food products be destroyed after having been placed in a refrigerator display case for a certain period of time.

With frozen foodstuff adverse effects are also produced. Because the defrost cycles are fairly long, usually 20 minutes, the frozen food packages develop humidity. As an example only with frozen ice-cream, often ice crystals will form on the container as well as inside the container. The effect of having ice crystal build-up on the outside of the container obstructs the label and further makes that container unattractive when left in the refrigerator for long periods of time. Because ice crystals have also built-up on the inside of the containers, the ice-cream will be subject to faster deterioration. In frozen food cabinets or enclosures, the temperature is expected to be maintained at −10° F. but during the defrost cycle, and particularly when doors to the enclosures are open, heat will rise into the enclosure as the defrost coils are being defrosted and defrost air is pushed into the cabinet.

SUMMARY OF INVENTION

It is a feature of the present invention to substantially overcome the above-mentioned disadvantages of the prior art by providing a high-speed evaporator defrost system which is quick and efficient.

Another feature of the present invention is to provide a high-speed evaporator defrost system wherein a high pressure differential is created across the refrigeration coil of the evaporator and through which hot high pressure refrigerant gas from the compressors is convected and thereby achieving high-speed passage through the refrigeration coil and therefore rapid defrosting by the hot high pressure refrigerant gas.

Another feature of this invention is to provide a high-speed evaporator defrost system wherein an auxiliary reservoir is interconnected between the suction header of the compressors and the low pressure return line from the evaporators during the defrost mode whereby to remove any liquid refrigerant that may be contained in the return line and not to create a surplus charge in the header of the compressor.

Another feature of the present invention is to provide an auxiliary reservoir between the suction header and the return line of the condensers in the defrost mode, wherein the auxiliary reservoir has a volume sufficient to take the full refrigerant load of a main reservoir of the refrigeration system.

Another feature of the present invention is to provide a floating head pressure circuit associated with the discharge line and condensers and wherein a return line from the auxiliary reservoir may be connected to the compressor discharge line to lower the temperature of the gas prior to feeding the condensers in the refrigeration mode and thereby increasing the efficiency thereof.

Another feature is to provide a high-speed evaporator defrost system wherein the head pressure of the compressors is not increased during the defrost cycle.

Another feature of the present invention is to provide a high-speed evaporator defrost system which may be adapted to existing refrigeration systems.

Another feature of the present invention is to provide a high-speed evaporator defrost system which is adaptable to refrigeration systems associated with display cases as well as frozen food enclosures.

Another feature of the present invention is to provide a high-speed evaporator defrost system capable of defrosting the evaporator coils of evaporators associated with display cases and within a time period of approximately 1 to 2 minutes as compared to prior art systems where the defrost cycle may take up to 12 minutes; and wherein the defrost cycle of refrigeration systems of frozen food enclosures is reduced to approximately 4 to 6 minutes instead of up to 22 minutes as with the prior art.

Another feature of the present invention is to provide a high-speed evaporator defrost system wherein food products are not adversely affected during the defrost cycle, thereby resulting in increased profitability due to a great reduction in loss of food products stored in such refrigeration equipment and in labor saving to rewrap or destroy such food products.

Another feature of the present invention is to provide a high-speed evaporator defrost system which does not adversely affect the quality of the food products being refrigerated in either refrigerated display case or in frozen food enclosures.

Another feature of the present invention is to provide a high-speed evaporator defrost system which does not affect the life of the refrigeration system equipment, such as the compressors, and which results in a reduction in energy consumption during the defrost cycle as compared to prior art systems.

According to the above features, from a broad aspect, the present invention provides a high-speed evaporator defrost system which comprises a defrost conduit circuit having valve means for directing hot high pressure refrigerating gas from a discharge line of one or more compressors and through a refrigeration coil of an evaporator, during a defrost cycle of a refrigeration system having one or more evaporators, and directly back to a suction header of the compressors through an auxiliary reservoir whereby to remove any liquid refrigerant contained in the refrigerant gas prior to returning to the suction header. The auxiliary reservoir has a volume sufficient to take the full refrigerant load of a main reservoir of the refrigeration system. Flushing means is provided to transfer accumulated liquid refrigerant from the auxiliary reservoir to the main reservoir when the refrigeration system is in a refrigeration cycle. The auxiliary reservoir of the defrost conduit circuit creates a pressure differential across the refrigeration coil sufficient to accelerate the hot high pressure refrigerant gas in the discharge line through the refrigeration coil of the evaporator to quickly defrost the refrigeration coil.

Figure 1B:
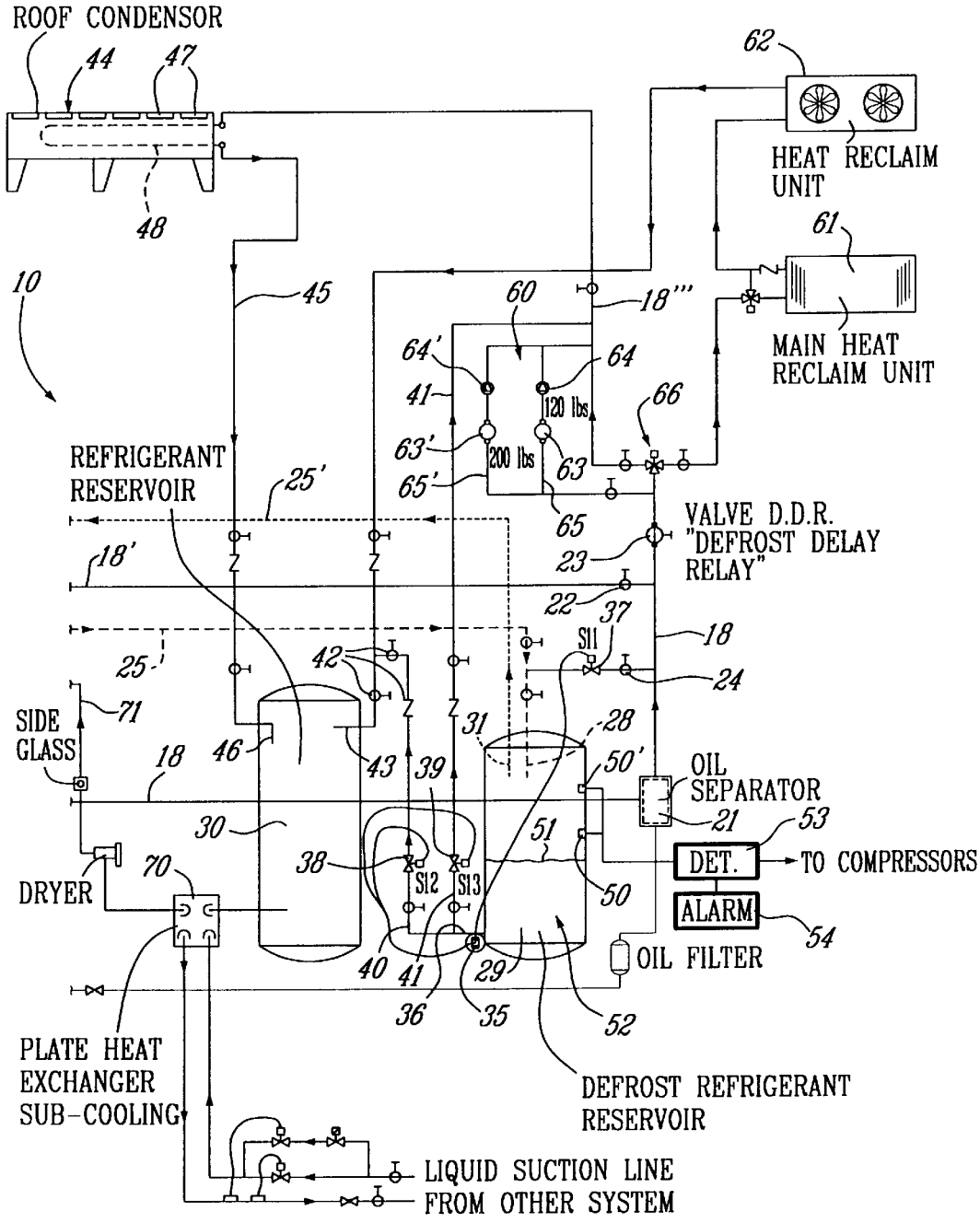

A preferred embodiment of the present invention will now be described with reference to the accompanying drawings in which;

FIG. 1 which is a schematic diagram of a refrigeration system to which has been adapted the high-speed evaporator defrost system of the present invention.

Referring to FIG. 1 there is shown generally at 10 a refrigeration system feeding evaporators associated with a plurality of refrigerated display cases and frozen food enclosure, not shown but obvious in the art. The system is provided with compressors 11 and one of these compressors may be a dedicated defrost compressor 11' as will be described later. A plurality of evaporators 12, herein only one being shown are associated with refrigerating display cases or refrigeration enclosures (not shown) whereby to maintain food at desired temperatures, as is well known in the art. As hereinshown a plurality of evaporator circuits 13 feed a respective evaporator or evaporators 12. Each evaporator 12 is provided with a coil or coils 14 and a cool refrigerant liquid/gas is fed to an inlet 15 of the coil 14 through an expansion valve 16 as is well known in the art. A unidirectional bypass valve 17 is connected in parallel with the expansion valve whereby the defrost refrigerant gas may flow in reverse through the coil during the defrost cycle, as will be described later.

When the refrigeration system 10 goes into a defrost cycle, hot refrigerant gas in the discharge line 18, from the discharge header 9 is connected to the hot gas header 8 and then to the outlet 19 of the refrigerant coil or coils 14 through a first valve, herein a solenoid operated valve 20. An oil separator 21 is provided in the discharge line 18 and the line connects to the outlet 19 of the coils through a valve 22 with valve 24 being closed and valve 23 being only partly closed to create a pressure differential.

As hereinshown the return line 25 of the defrost circuit which connects to the inlet 15 of the evaporator 12 is provided with a second valve means, herein valve 26, which is opened during the defrost cycle with valve 27 being closed. This valve 26 connects the return line 25, through the return liquid header 5 and then to an inlet discharge pipe 28 of an auxiliary reservoir 29. The auxiliary reservoir 29 has a volume sufficient to take the full refrigerant load of the main reservoir 30 of the refrigeration system 10. It is pointed out that a dedicated return line may be connected from the inlet 15 of the evaporator 12 directly to the auxiliary reservoir 29 eliminating the bypass unidirectional valve 17. All evaporators in the refrigeration system could be connected to this dedicated return line.

As the hot high pressure gas in the discharge line 18 is convected through the refrigeration coil or coils 14 of evaporator 12 to defrost same, the gas will cool down and condensate may be formed in such gas. Any condensate or liquid refrigerant convected in the gas through the return line 25 will be released into the auxiliary reservoir 29 and accumulate therein during the defrost cycle. A further return line 25' is connected to a gas outlet 31 of the auxiliary reservoir and feeds the low pressure suction header 32 which connects to the compressors 11 where the gas is again compressed by the compressors to increase the pressure thereof to feed the main reservoir 30 through condensers to provide cool refrigerant liquid for the refrigeration mode of the system 10.

As previously described, a dedicated defrost compressor 11' may be provided for the defrost cycle of the system. Assuming the compressor 11' is a dedicated compressor, then the compressor discharge line, identified in stippled line at 18' would connect directly to the discharge line 18 through three-way valve 7. The connecting line 18" including valve 22 would not then be required.

In order to maintain the main reservoir 30 supplied with sufficient quantities of refrigerant liquid to efficiently operate during the refrigeration cycle, it is necessary to flush the auxiliary reservoir 29 during the refrigeration cycle of the refrigeration system 10. It is pointed out that by using an auxiliary reservoir, a pressure differential can be created across the refrigeration coils of the evaporators within the range of about 30 p.s.i. to 200 p.s.i. thus achieving quick defrost. The flushing circuit is comprised of a temperature sensing device 35 which is secured to the outlet 36 of the auxiliary reservoir 29 to detect the temperature of the liquid refrigerant accumulated in the auxiliary reservoir whereby to make a determination when the accumulated liquid refrigerant needs to be flushed, i.e. at 34° F. The exterior temperature is sensed by a monitoring device and feeds a signal to a controller of the system (not shown) which then determines where the refrigerant liquid from the auxiliary reservoir is to be directed to feed the main reservoir 30. The controller (not shown but obvious in the art) controls valve 23 as well as valve 37 and valve 6 whereby to direct hot pressure gas from the discharge line 18 back into the top portion of the auxiliary tank to pressurize the tank and flush out the liquid accumulated therein when valve 37 is opened, valve 6 is closed. During the defrost cycle and the refrigeration cycle valve 6 is open and closed only during flushing. The controller also operates a first and second solenoid operated valve 38 and 39 associated respectively with a first and second feedback circuits 40 and 41.

The first feedback circuit 41 is connected through a series of valves 42 to a discharge pipe 43 located at the top of the main reservoir to feed refrigerant liquid therein directly from the auxiliary reservoir when the liquid refrigerant is below a predetermined temperature, normally below 34° F. If the outside temperature is above 50° F., the valve 38 will be closed and valve 39 opened whereby to direct the refrigerant liquid into the circuit line 41 and back into the roof condenser 44. It is pointed out that valve 23 is a restraining valve which restrains pressure to created a pressure differential of about 30 pounds to feed the top part of the auxiliary reservoir 29 to create sufficient pressure to flush out most of the liquid refrigerant accumulated therein. The system flushes the auxiliary reservoir after each defrost cycle.

The liquid refrigerant in the feedback circuit 41 will mix with some of the refrigerant in the discharge line 18' which feeds the roof condenser 44 and lower the temperature of that hot refrigerant gas to increase the efficiency of the condenser 44. The cooled refrigerant liquid from the condenser 44 is fed back into the main reservoir 30 through conduit 45 which connects to the discharge pipe 46. Accordingly, sufficient liquid refrigerant is maintained in the main reservoir 30 to ensure proper operation of the system during the refrigeration cycle.

The roof condenser 44 is of the standard type as is well known in the art and has a plurality of fans 47 and condensing coils 48 to condense refrigerant gas circulated in the coils 48. The condenser 44 could also be a split condenser.

The auxiliary reservoir 29 may also be provided with a level detector 15 which detects the level 51 of refrigerant liquid 52 accumulated in the auxiliary reservoir. When the level 51 of the liquid refrigerant 52 reaches the predetermined level, as detected by the detector 50 the compressors will be cut off. In the event that the lower detector 50 fails, a further level detector 50' will also feed a signal to the liquid detecting circuit 53 which will operate an alarm circuit 54 and automatically shut down the compressors 11 whereby to ensure that no liquid refrigerant is fed back to the header 32. It is important to note that any liquid refrigerant must be prevented from being fed back into the header 32 as this could be damaging to the compressors 11.

A floating head pressure circuit 60 is also coupled to the discharge line 18 and 18" of the compressors 11 to increase the efficiency of the compressors and the condensers associated with the system. As hereinshown the system is provided with one or more roof condensers 44 and one or more heat reclaim heat exchangers 61 and 62, these latter being utilized during a winter climatic mode of operation of the refrigeration system 10. The floating head pressure circuit 60 is provided with pressure control means to automatically cycle the circuit during different climatic ambient temperatures. The pressure control means is provided by a solenoid valve 63 and a modulating valve 64 associated with a first branch circuit 65 and a further solenoid valve 63' and a further modulating valve 64' associated with a second branch circuit 65'. These solenoid valves are operated upon detecting a predetermined outside ambient temperature. It is pointed out that the floating head pressure circuit 60 may be constituted by a single modulated valve (not shown but known in the art). During winter climatic condition the refrigerant gas pressure will be increased to approximately 200 p.s.i. by the modulating valve 64' wherein in the summer mode and in between seasons the pressure is maintained lower by the modulating valve 64 and usually at a 120 p.s.i. The valve network 66 directs the refrigerant liquid from the discharge line 18 to the heat reclaim exchangers 61 and 62 during winter climatic conditions to recover heat to heat building enclosures. During the summer climatic conditions the hot refrigerant gas is directed to the roof condensers 44 and in both cases the cooled refrigerant liquid is fed back to the discharge pipes 43 or 46 of the main reservoir 30. Also, during the summer the valve network 66 may direct the hot gas to the heat reclaim coils 61, 62 to provide dehumidification. By modulating compressor head pressure there is achieved a saving in energy by cycling compressors. The defrost system of the present invention will operate quickly and effectively at head pressures of 100 p.s.i. as the auxiliary reservoir may be at 1 to 30 p.s.i.

In the refrigeration cycle, cool refrigerant liquid from the main reservoir is again cooled by heat exchanger 70 which feeds the refrigerant line 71 which now feeds cool refrigerant to the coils 14 of the evaporator 12 from the inlet end 15 to the outlet end 19.

It is within the ambit of the present invention to cover any obvious modifications of the preferred embodiment of the present invention and its examples as illustrated herein, provided such modifications fall within the ambit of the appended claims. Sufficient only to point out that the present invention resides in a high-speed defrost system which is accomplished by creating a large pressure differential across the refrigeration coil of the evaporator during the defrost cycle whereby hot high pressure gas from the compressor(s) will flow through the refrigeration coil very quickly to achieve rapid defrost. Protection of the compressors and the high pressure differential is achieved by the auxiliary reservoir 29. For example, pressure differentials of the hot high pressure gas which is usually at a pressure of about 100–200 p.s.i. and passing to 0–30 p.s.i. across the evaporator will result in rapid defrost. With the present invention, the defrosting of evaporator refrigerant coils in refrigerated display cases is achieved within approximately 1 to 2 minutes instead of 12 minutes as with previous known systems. In frozen food enclosures the defrost cycle was reduced to about 4 to 6 minutes instead of 22 minutes. The pressure differential should be preferably in the range of from about 30 to 200 p.s.i. This system may be retro-fitted on existing refrigeration systems, and can be incorporated in the construction of new systems.

The defrost system of the present invention further permits floating head pressure (modulation) of the compressors from about 75 p.s.i. to about 200 p.s.i. This permits the saving of energy when outside temperature is colder. When the temperature outside is colder, a controller of the refrigeration system lowers the head pressure by operating the roof condensers (by operating more fans) to lower the compressor head pressure and work at lower pressure on the discharge and liquid lines thereby requiring less compressors. For example, at 100 p.s.i. on the discharge line 18, the compressors can be cut by 50%. If only 100 or 175 p.s.i. head pressure is available, we can still defrost the evaporators as the return line 25 feeding the auxiliary reservoir 29 is at a pressure of about 1 to 30 p.s.i., this providing a pressure differential of 73 to 74 p.s.i., sufficient to defrost quickly.

What is claimed is:

1. A high-speed evaporator defrost system comprising a defrost conduit circuit having valve means for directing hot high pressure refrigerant gas from a discharge line of one or more compressors and through a refrigeration coil of an evaporator, during a defrost cycle of a refrigeration system having one or more evaporators, and directly back to a suction header of said one or more compressors through an auxiliary reservoir to remove any liquid refrigerant contained in said refrigerant gas prior to returning to said suction header, said auxiliary reservoir having a volume sufficient to take the full refrigerant load of a main reservoir of said refrigeration system, flushing means to transfer accumulated liquid refrigerant from said auxiliary reservoir to said main reservoir when said refrigeration system is in a refrigeration cycle, said auxiliary reservoir of said defrost conduit circuit having an internal pressure which is at the same pressure as that of a suction header of said one or more compressors thereby creating a pressure differential across said refrigeration coil sufficient to accelerate said hot high pressure refrigerant gas in said discharge line through said refrigeration coil of said evaporator to quickly defrost said refrigeration coil.

2. A high-speed evaporator defrost system as claimed in claim 1 wherein said pressure differential is in the range of from about 30 p.s.i. to 200 p.s.i.

3. A high-speed evaporator defrost system as claimed in claim 1 wherein said valve means comprises a first valve interconnected between said discharge line to an outlet end of said refrigeration coil when said evaporator is in a refrigeration cycle, and a second valve interconnected between an inlet end of said refrigeration coil and said auxiliary reservoir.

4. A high-speed evaporator defrost system as claimed in claim 1 wherein said one or more compressors is a single dedicated defrost compressor independently operated during said defrost cycle and connected to said discharge line.

5. A high-speed evaporator defrost system as claimed in claim 3 wherein said flushing means comprises a temperature sensing secured to an outlet of said auxiliary reservoir to detect the temperature of said liquid refrigerant accumulated in said auxiliary reservoir, a controller for receiving a signal from said temperature sensing device for operating a flushing valve to connect an infeed line of said auxiliary reservoir to said discharge line in the refrigeration cycle of said refrigeration system to pressurise said auxiliary reservoir to flush said liquid refrigerant therein back to said main reservoir through a feedback conduit circuit having further valve means operable by said control device.

6. A high-speed evaporator defrost system as claimed in claim 5 wherein said feedback conduit circuit is comprised of a first conduit circuit having first valve means controlled by said controller depending on exterior temperature to convect said liquid refrigerant directly to said main reservoir, and a second conduit circuit having second valve means controlled by said controller device to convect said liquid refrigerant to remote condenser means to further cool said liquid refrigerant prior to feeding same to said main reservoir.

7. A high-speed evaporator defrost system as claimed in claim 6 wherein, said second conduit circuit is connected to said discharge line wherein cooled liquid refrigerant from said auxiliary reservoir will mix with hot refrigerant gas in said discharge line to lower the temperature of said hot refrigerant gas prior to being circulated and further cooled in said remote condenser means thereby increasing the efficiency of said remote condenser means and lowering compressor head pressure.

8. A high-speed evaporator defrost system as claimed in claim 7 wherein said remote condenser means is a roof condenser having a plurality of fans to cool and condensate refrigerant liquid/gas circulated in coil provided therein.

9. A high-speed evaporator defrost system as claimed in claim 3 wherein there is further provided level detecting means to sense the level of said liquid refrigerant in said auxiliary reservoir to initiate an alarm when said liquid refrigerant in said auxiliary reservoir reaches a predetermined high level indicating that said compressors need to be shut-down.

10. A high-speed evaporator defrost system as claimed in claim 3 wherein there is further provided a floating head pressure circuit coupled to said discharge line and said main reservoir to increase the efficiency of condenser means associated with said discharge line to lower the temperature of said refrigerant liquid/gas by extracting heat therefrom, said floating head pressure circuit having pressure control means dependent on climatic ambient temperatures to lower compressor head pressure and reduce energy consumption while maintaining a rapid defrost cycle for said evaporators.

11. A high-speed evaporator defrost system as claimed in claim 10 wherein said pressure control means comprises a first branch line of said pressure circuit provided with a solenoid valve and a series connected modulating valve to adjust the pressure in said refrigerant discharge line for operation in a summer climatic mode, and a second branch line also provided with a solenoid valve and a series connected modulating valve to adjust the pressure in said refrigerant discharge line higher than in said first branch line for operation in a winter climatic mode.

12. A high-speed evaporator defrost system as claimed in claim 11 wherein said condenser means is one of a roof condenser and heat reclaim exchangers.

13. A high-speed evaporator defrost system as claimed in claim 12 wherein said heat exchangers are connectable between said discharge line and said main reservoir.

14. A high-speed evaporator defrost system as claimed in claim 12 wherein said discharge circuit is provided with directional flow control valves to connect same to said roof condenser or said heat reclaim exchangers.

15. A high-speed evaporator defrost system as claimed in claim 3 wherein there is further provided liquid refrigerant level detecting means to sense an alarming level of said liquid refrigerant in said auxiliary reservoir when at a predetermined alarming level and to shut-down said one or more compressors and produce an alarm.

* * * * *